US005563643A

United States Patent [19]

Carlotta et al.

[11] Patent Number: 5,563,643

[45] Date of Patent: Oct. 8, 1996

[54] INK JET PRINTHEAD AND INK SUPPLY MANIFOLD ASSEMBLY HAVING INK PASSAGEWAY SEALED THEREBETWEEN

[75] Inventors: Michael Carlotta, Sodus; Vladimir M. Kupchik, Pittsford, both of N.Y.

[73] Assignee: Xerox Corporation, Stamford, Conn.

[21] Appl. No.: 176,189

[22] Filed: Jan. 3, 1994

[51] Int. Cl.[6] ..... B41J 2/175

[52] U.S. Cl. ..... 347/87

[58] Field of Search ..... 347/20, 63, 87

[56] References Cited

U.S. PATENT DOCUMENTS

| | | | |
|---|---|---|---|
| 4,580,148 | 4/1986 | Domoto et al. | 347/63 |
| 4,771,295 | 9/1988 | Baker et al. | 347/87 |
| 4,774,530 | 9/1988 | Hawkins | 347/63 |
| 4,791,438 | 12/1988 | Hanson et al. | 347/87 |
| 5,233,369 | 8/1993 | Carlotta et al. | 347/87 |
| 5,278,584 | 1/1994 | Keefe et al. | 347/87 |
| 5,289,212 | 2/1994 | Carlotta | 347/87 |
| 5,412,410 | 5/1995 | Rezanka | 347/42 X |

OTHER PUBLICATIONS

Xerox Disclosure Journal, vol. 16, No. 4, Jul./Aug. 1991, p. 235.

*Primary Examiner*—Alrick Bobb

[57] ABSTRACT

In a printhead assembly, an ink jet printhead is fixed to the wall of an ink supply manifold. The printhead has an ink inlet in communication with a plurality of nozzles, and the manifold contains liquid ink which flows to the printhead inlet through an outlet in the manifold wall. A preformed hot melt adhesive member with a slot therein is positioned between the manifold wall and the printhead with the slot of the adhesive member surrounding the manifold outlet and printhead inlet, so that when the adhesive member is heated and cooled a hermetic seal is formed.

8 Claims, 6 Drawing Sheets

INK JET PRINTHEAD AND INK SUPPLY MANIFOLD ASSEMBLY HAVING INK PASSAGEWAY SEALED THEREBETWEEN

BACKGROUND OF THE INVENTION

This present invention relates to an ink cartridge for a thermal ink jet printer having an ink jet printhead sealingly connected to an ink supply manifold, and more particularly to a thermal ink jet printhead assembly having a printhead with an inlet sealed to an outlet of an ink supply manifold by a preformed hot melt adhesive member.

In existing thermal ink jet printing, the printhead comprises one or more ink filled channels, such as disclosed in U.S. Pat. No. 4,774,530, communicating with a relatively small ink supply chamber, or reservoir, at one end and having an opening at the opposite end, referred to as a nozzle. A thermal energy generator, usually a resistor, is located in each of the channels, a predetermined distance from the nozzles. The resistors are individually addressed with a current pulse to momentarily vaporize the ink and form a bubble which expels an ink droplet. The acceleration of the ink out of the nozzle while the bubble is growing provides the momentum and velocity of the droplet in a substantially straight line direction towards a recording medium, such as paper. Because the droplet of ink is emitted only when the resistor is actuated, this general type of thermal ink jet printing is known as "drop-on-demand" printing.

In current practical embodiments of drop-on-demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure," exist in each of the nozzles and, by extension, within the ink supply manifold of the printhead. A discussion of desirable ranges for back pressure in thermal ink jet printing is given in the "Xerox Disclosure Journal," Vol. 16, No. 4, July/August 1991, p. 233. This back pressure is important for practical applications to prevent unintended leakage, or "weeping," of liquid ink out of the nozzles onto the copy surface. Such weeping will obviously have adverse results on copy quality, as liquid ink leaks out of the printhead uncontrollably.

A typical end-user product in this art is a cartridge in the form of a prepackaged, usually disposable, assembly comprising a sealed container holding a supply of ink and, operatively attached thereto, a printhead having a linear or matrix array of channels. Generally the cartridge may include terminals to interface with the electronic control of the printer; electronic parts in the cartridge itself are associated with the ink channels in the printhead, such as the resistors and any electronic temperature sensors, as well as digital means for converting incoming signals for imagewise operation of the heaters. In one common design of printer, the cartridge is held with the printhead spaced from, but closely adjacent, the sheet on which an image is to be rendered, and is then moved across the sheet periodically, in swaths, to form the image, much like a typewriter. Full-width linear arrays, in which the sheet is moved past a linear array of channels which extends across the full width of the sheet, are also known. Typically, cartridges are purchased as needed by the consumer and used until the supply of ink is exhausted, at which time the consumer replaces the cartridge.

Other considerations are crucial for a practical ink supply as well. The back pressure, for instance, must be maintained at a usable level for as long as possible while there is still a supply of ink in an ink cartridge. Therefore, a cartridge must be so designed as to maintain the back pressure within the usable range for as large a proportion of the total range of ink levels in the cartridge as possible. Failure to maintain back pressure causes the ink remaining in the cartridge to leak out through the printhead or otherwise be wasted.

U.S. Pat. No. 5,233,369 discloses an ink-supply cartridge wherein two chambers are provided, the upper chamber having a capillary foam and the lower chamber substantially filled with ink. The printhead is disposed at a vertical height greater than the top level of the lower chamber. A second capillary foam, disposed along the supply line to the printhead, has a capillarity greater than that of the foam in the upper chamber. In another embodiment, only one chamber, corresponding to the lower chamber in the first embodiment and having no capillary foam therein, is provided.

U.S. Pat. No. 4,771,295 discloses an ink-supply cartridge construction having multiple ink storage compartments. Ink is stored in a medium of reticulated polyurethane foam of controlled porosity and capillarity. The medium empties into ink pipes, which are provided with wire mesh filters for filtering of air bubbles and solid particles from the ink. The foam is also compressed to reduce the pore size therein, thereby reducing the foam thickness while increasing its density; in this way, the capillary force of the foam may be increased.

U.S. Pat. No. 4,791,438 discloses an ink jet pen (ink supply) including a primary ink reservoir and a secondary ink reservoir, with a capillary member forming an ink flow path between them. This capillary member draws ink from the primary reservoir toward the secondary ink reservoir by capillary action as temperature and pressure within the primary reservoir increases. Conversely, when temperature and pressure in the housing decreases, the ink is drawn back toward the primary reservoir.

Copending U.S. Ser. No. 08/151,625, filed Nov. 15, 1993, entitled "Ink Supply Cartridge For An Ink Jet Printer" by Dietl et al. and assigned the same assignee as the present invention, discloses the use of a thin layer of a film forming polymer, such as Mylar®, having a predetermined shape and a slot therethrough, with a thermosetting adhesive layer on both sides to form an ink passageway when positioned over an elongated recess in an external surface of an ink supplying cartridge to complete the passageway by functioning as the missing remaining wall. The cartridge outlet is connected to the recess, and the printhead is mounted against the film layer in such a manner that the printhead inlet is aligned with the slot in the film layer. The adhesive layer on one side of the film layer bonds the film layer to the cartridge and the adhesive layer on the other side bonds the printhead thereto and concurrently seals the film layer slot to the printhead inlet. Because the adhesive layers are exposed to the ink, the adhesive is a type that is not attacked by the ink.

SUMMARY OF THE INVENTION

It is an object of the invention to effect a seal between an ink supply manifold outlet and an ink inlet of an ink jet printhead without the use of a supporting film member therebetween whether the manifold outlet is aligned with the printhead inlet or not.

It is another object of the invention to seal the manifold outlet to the printhead inlet by use of a preformed, hot melt adhesive member, which flows at temperatures above its softening point along confronting substantially planar surfaces of the printhead and manifold that the flowable adhesive member contacts, but not into the inlet and outlet, and, when cooled, to form a robust seal without the need of an adhesive supporting film member.

In the present invention, a cartridge for supplying liquid ink to a thermal ink jet printing apparatus comprises a manifold defining a chamber having a wall with an outlet port therein. An absorbent medium occupies at least a portion of the chamber, the absorbent medium being adapted to retain a quantity of liquid ink. In one embodiment, an ink passageway is formed when an elongated recess in the external surface of the manifold wall is covered by a preformed, hot melt adhesive member having a predetermined geometry. A small slot in the preformed adhesive member serves as an outlet from the passageway and is aligned with and seals the printhead inlet. The passivation layer covering the wire bonds between the printhead and adjacent printed wire board is shaped and at least partially cured to provide a surface substantially coplanar with the printhead surface having the ink inlet. The combined printhead surface and passivation layer surface support the hot melt adhesive member. In another embodiment the combined, coplanar printhead surface and passivation layer surface form the ink passageway between the manifold outlet and printhead inlet, with the slot in the adhesive member having a similar shape as the recess in the manifold wall. In a further embodiment the ink passageway between the manifold outlet and printhead inlet is formed internally in the manifold wall, so that the preformed, hot melt adhesive member has a shape which surrounds the exit opening from the passageway and confronting printhead inlet. In this embodiment, no preshaped passivation layer with coplanar surface is required to support the adhesive member or to complete the passageway as in the other embodiments. When the hot melt adhesive member is heated above its softening point, the adhesive flows along confronting surfaces of the manifold and combined printhead and passivation surfaces, but because of its high contact angle, does not flow into the printhead inlet or manifold wall recess.

When cooled, a robust seal is formed without the need of an adhesive supporting film member and without the need of highly toleranced adhesive member shapes or slots therein. This is because elevating the temperature of the adhesive causes it to flow completely covering all surface areas until it reaches corners, where the high contact angle of the adhesive causes the adhesive to stop. This feature prevents the printhead inlets and manifold recesses or outlets from being coated or clogged with the flowable adhesive. Thus, the slot in the adhesive member does not have to be substantially identical to the printhead inlet or the manifold recess. Instead, they may be slightly larger and flow to inlet or recess, prior to cooling.

BRIEF DESCRIPTION OF THE DRAWINGS

By way of example, an embodiment of the invention will be described with reference to the accompanying drawings, wherein like numerals indicate like parts, in which.

DESCRIPTION OF THE PREFERRED EMBODIMENT

Figure 1:
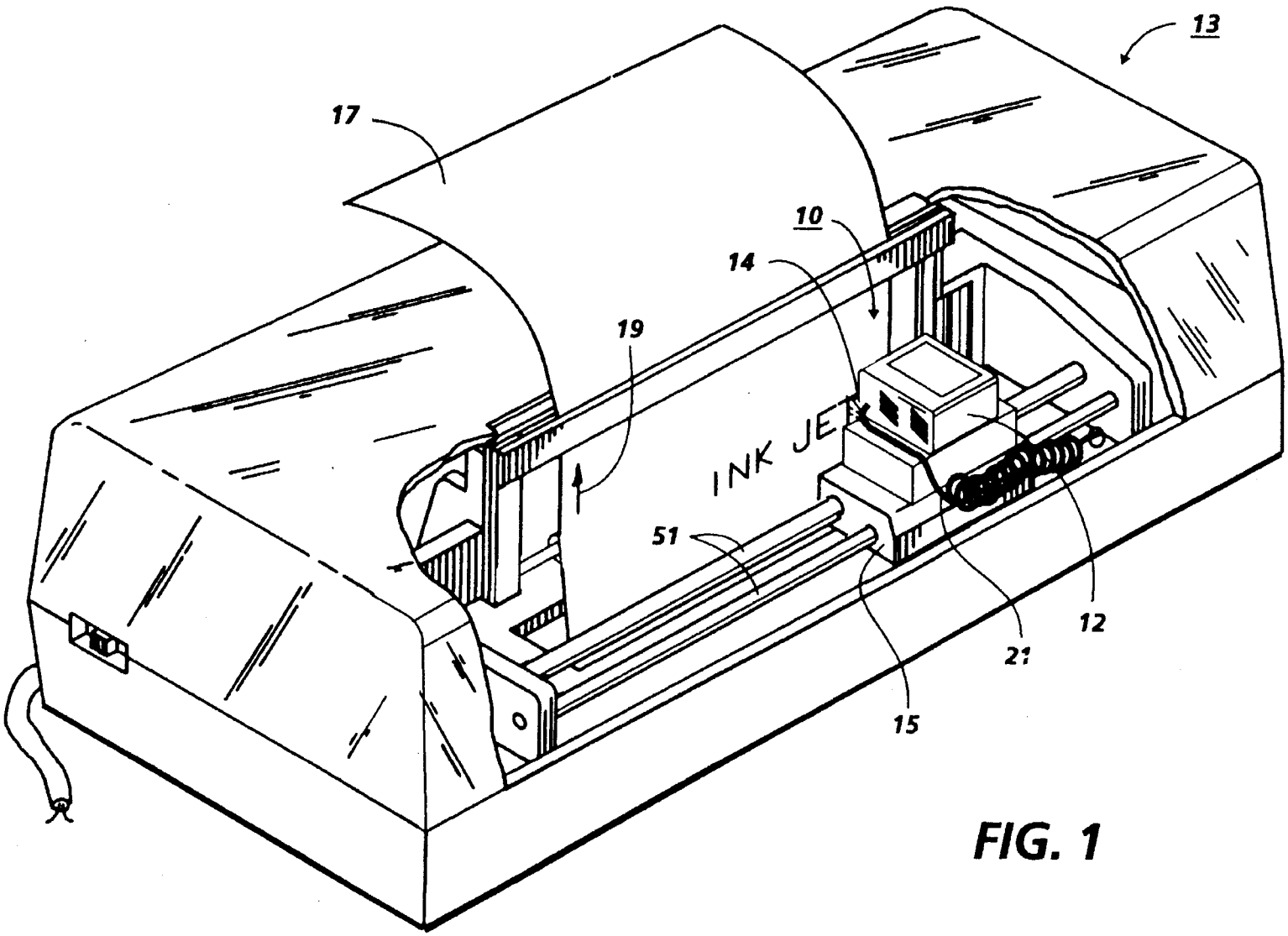
FIG. 1 is an isometric view of a thermal ink jet printer having the printhead assembly with the preformed, hot melt seal and shaped wire bond passivation of the present invention.

FIG. 1 is a schematic, isometric view of a type of thermal ink jet printer 13 in which the printhead 14 and the ink supply therefor are combined in a single package, referred to hereinafter as printhead assembly or cartridge 10. The main portion of cartridge 10 is the ink supply contained in manifold 12, with another portion containing the actual printhead 14. In this embodiment of the invention, cartridge 10 is installed in a thermal ink jet printer 13 on a carriage 15 which is translated back and forth across a recording medium 17, such as, for example, a sheet of paper, on guide rails 51. During the translation of the printhead 14 by the carriage 15, the printhead moves relative to sheet 17 and prints characters on the sheet 17, somewhat in the manner of a typewriter. In the example illustrated, printhead 14 is of such a dimension that each translation of cartridge 10 along sheet 17 enables printhead to print with a swath defined by the height of the array of nozzles in printhead and the width of the sheet. After each swath is printed, sheet 17 is indexed (by means not shown) in the direction of the arrow 19, so that any number of passes of printhead 14 may be employed to generate text or images onto the sheet 17. Cartridge 10 also includes means, generally shown as cable 21, by which digital image data may be entered into the various heating elements (not shown) of printhead 14 to print out the desired image. This means 21 may include, for example, plug means which are incorporated in the cartridge 10 and which accept a bus or cable from the data processing portion (not shown) of the apparatus, and permit an operative connection therefrom to the heating elements in the printhead 14.

Figure 2:
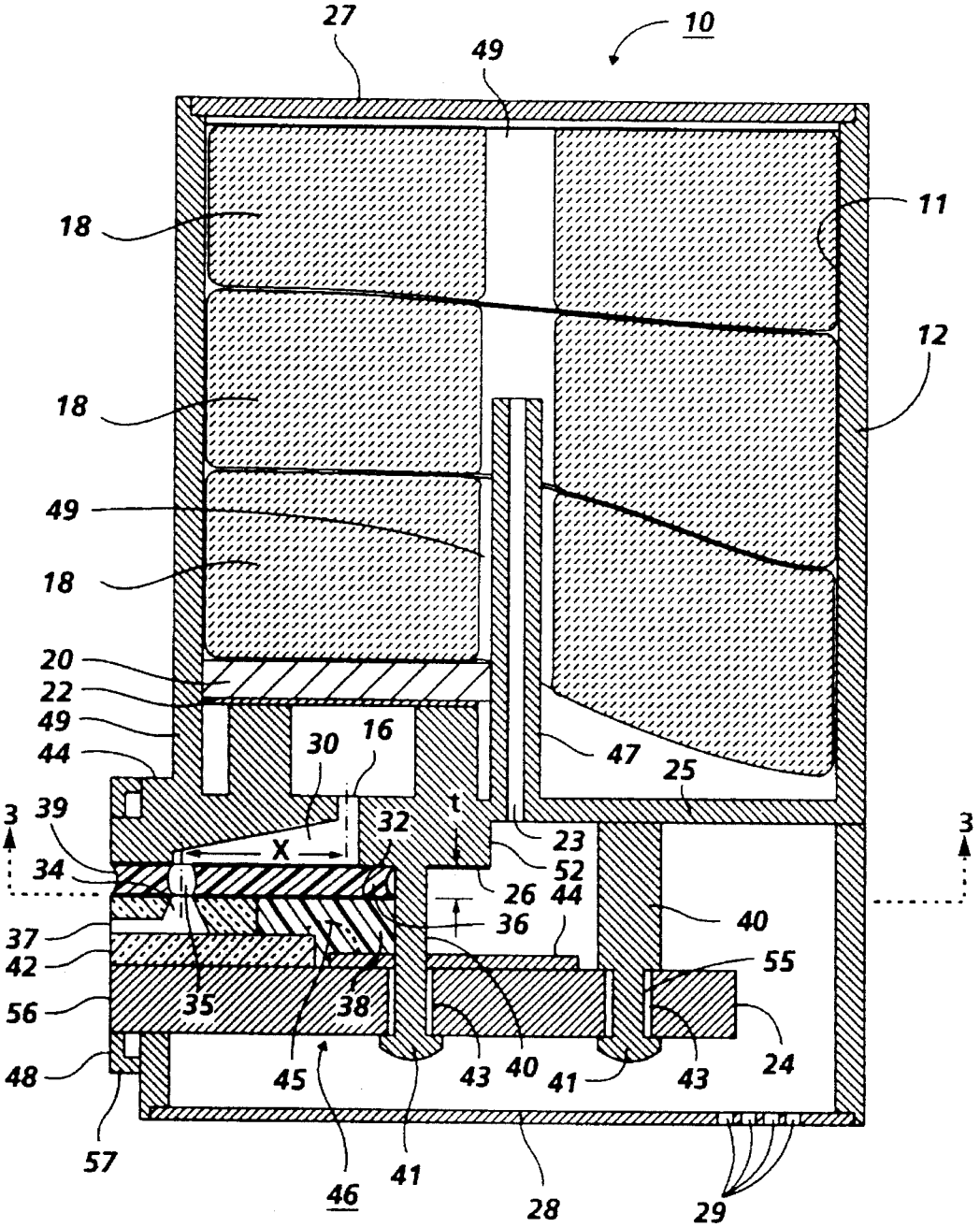
FIG. 2 is a schematic, cross-sectional elevation view of the printhead assembly in FIG. 1, showing the preformed, hot melt seal and shaped wire bond passivation of the present invention.

FIG. 2 is a schematic sectional, elevational view of the printhead assembly or cartridge 10. The cartridge 10 has a main portion in the form of a manifold 12. Manifold 12 is typically made of a lightweight but durable plastic. Manifold 12 defines an internal chamber 11 for the storage of liquid ink having a wall 25 with a ventilation port or vent 23, open to the atmosphere, and an ink output port or outlet 16. An elongated recess or trench 30 of varying depth is formed in the outer wall surface 26, which extends from the wall 25 to increase the wall thickness, thereby forming a step 52 on the housing wall 25. The recess 30 may be integrally molded in the chamber wall surface concurrently with the fabrication of the manifold 12. One end of the elongated recess 30 is connected to the outlet 16 and the other end terminates at a location which will align with the inlet 34 of the printhead when it is attached to the chamber wall 25. The distance "X" from the center of the outlet 16 to the center of the printhead inlet 34 is about 10 min. The offset distance X between chamber outlet 16 and printhead inlet 34 is necessitated because the nozzles 37 in printhead nozzle face 42 must be closely spaced from the recording medium by, for example, a distance of about 20 mils. This spacing is within the warping or cockling dimension of the recording medium, such as paper, which is the typical response to wet ink on the surface thereof. To prevent the manifold from contacting or dragging on the cockles of the recording medium produced by the recently printed wet ink images thereon, the printhead nozzle face must be projected beyond the cartridge manifold 12. In order to mount the printhead so that the nozzles are projected from the cartridge, a portion of the manifold adjacent the printhead is protruded therefrom as projection 44 (also see FIG. 3). With the printhead mounted in the manifold projection 44, the printhead inlet is positioned beyond the manifold. The recess 30, which provides the ink passageway between the ink supply in chamber 11 and the printhead 14, must be sized to accommodate an appropriate rate of ink flow in order to prevent lack of timely refill of the printhead reservoir and/or pressure surges which cause the nozzles to weep ink. If the refill is too slow the printhead will malfunction. Accordingly, the ink flow inertance must be matched to the ink flow inertance of the printhead when it is printing. Inertance, is defined as the momentary pressures or pressure pulses generated by the acceleration of the fluid ink. In the preferred embodiment, the ink passageway between the printhead inlet 34 and ink supply chamber outlet 16 is geometrically shaped to have a cross-sectional flow area that increases from the printhead inlet to the chamber outlet. Though the preferred embodiment has only one recess 30, a plurality of recesses could be provided. In addition to maximizing the rate of flow of ink to the printhead and matching the ink flow inertance, the increasing cross-sectional area enables a smooth ink flow transition from the manifold outlet 16 to the relatively small printhead inlet 34.

A relatively thin preformed adhesive member 36, having a predetermined shape and a slot 35 therethrough, is placed on and subsequently bonded to the wall surface 26, covering the recess 30 in the outer or external surface 26 of the chamber wall 25. The slot 35 is substantially the same size as the printhead inlet and preferably slightly larger. The adhesive member has opposing surfaces 31, 33, shown in FIG. 4. The adhesive member 36 is in direct contact with the ink flowing through the passageway formed by the recess 30 and the adhesive member 36, so that the adhesive should be insoluble in components utilized in the ink. Any suitable hot melt adhesive may be used, such as, for example, H. B. Fuller's 2106® hot melt adhesive. The properties of the hot melt adhesive should include a relatively low softening and tacking temperature of about 95° C. to 105° C. and a flowable temperature of about 180° C. to 200° C. The hot melt adhesive, when heated to the flowable state, should have a high contact angle with the surfaces to be bonded and sealed, so that the adhesive will not flow beyond the edges of the substantially planar surfaces which the adhesive contacts and, thus, will not flow into the manifold recess 30 or into the printhead inlet 34. Finally, the hot melt adhesive must firmly adhere to the material of the manifold, printhead, and passivation layer. In the preferred embodiment, the material for the manifold, printhead, and passivation layer is plastic, silicon, and epoxy resin, respectively.

The adhesive member 36 is positioned against the bottom or outer surface 26 of the manifold chamber wall 25 and the temperature raised to about 95° C. to 105° C. to cause the adhesive member surface 31 to adhere or tack thereto. The adhesive member is shaped to avoid the locating and fastening pins 40 integrally formed or molded with the manifold 12 and used to fixedly attach the printhead 14 and heat sink 24, as discussed later. The elongated recess 30 is hermetically sealed by the adhesive member 36 which resides on the combined coplanar surfaces of the printhead surface with the inlet 34 and the surface 32 of the shaped or molded passivation layer 38 for the wire bonds 45 (discussed later) to form a closed ink passageway from the cartridge chamber 11 to the printhead nozzles 37.

Figure 8:
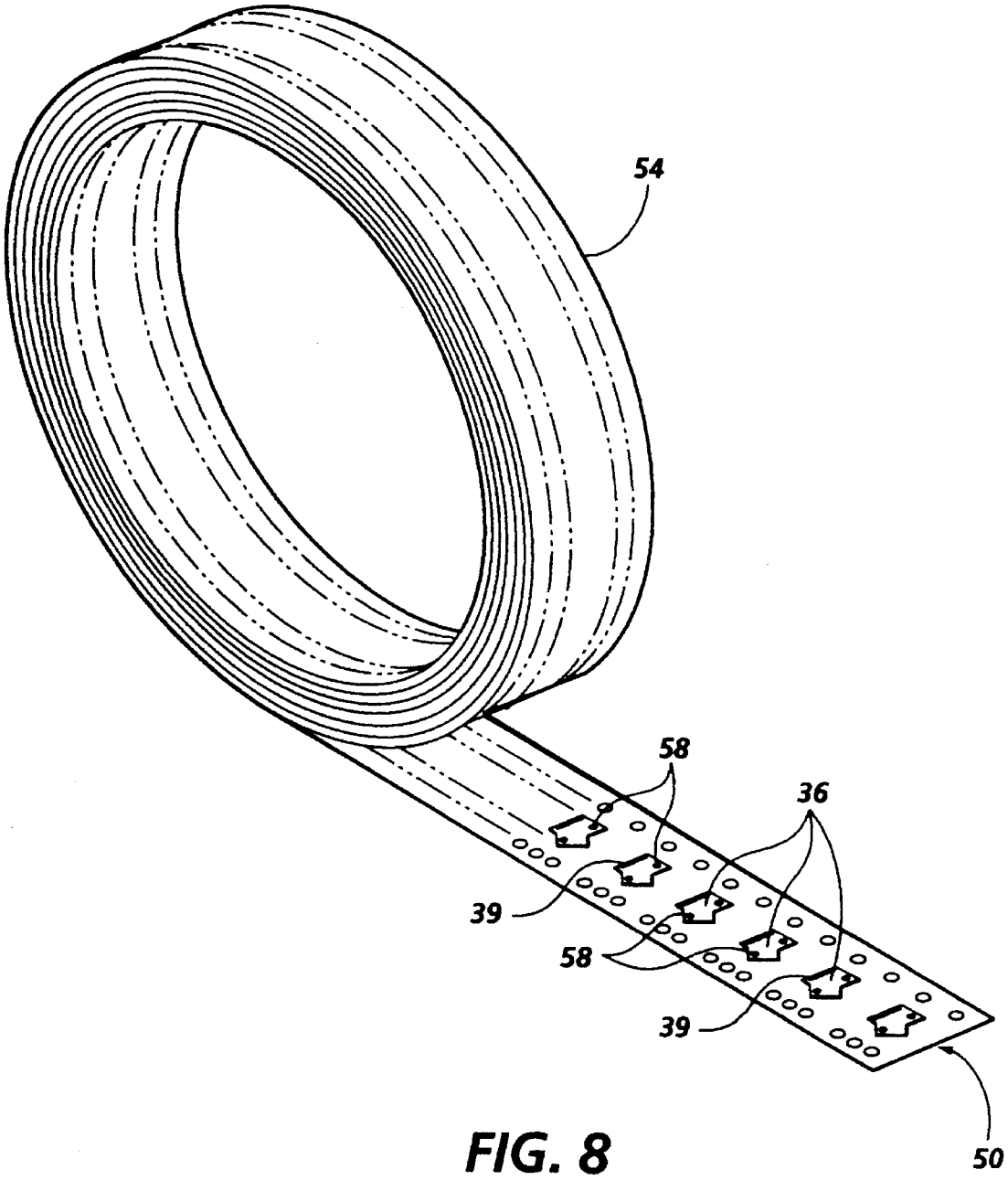
FIG. 8 is a schematic, isometric view of a roll of carrier strip containing a plurality of preformed, hot melt members releasably held thereon.

The adhesive member 36 has a thickness of about 4 to 10 mils and preferably 7 mils, and for automated assembly purposes may be then be laminated to a 2 to 6 mils thick, preferably 3 mils thick, polyester release carrier strip 50 (see FIG. 8) on side surface 31. A punching operation is used to first punch through the geometrical features of preformed periphery, ink slot 35, and front edge 39 which is coplanar with the printhead nozzle face 42. Only the adhesive members 36 are left on the carrier strip equally spaced therealong with the scrap material of 7 mil thick hot melt adhesive strip from which the adhesive members are punched is removed leaving a complete adhesive member 36 spaced every 1.5 inches down a 4,000 inch long polyester carrier strip 50 rolled on a spool or reel 54. The reel of adhesive members are fed into a pick and place zone of a robotic device (not shown) and the adhesive members 36 are peeled and vacuum picked off the carrier strip 50, positioned to the manifold wall surface 26 using a vision system (not shown), and placed onto the manifold wall surface 26 with a specified pressure of less than 50 psi and temperature of about 95° C. to 105° C. This pressure and temperature tacks the adhesive member to the wall surface 26 without causing the adhesive to flow.

Figure 5:
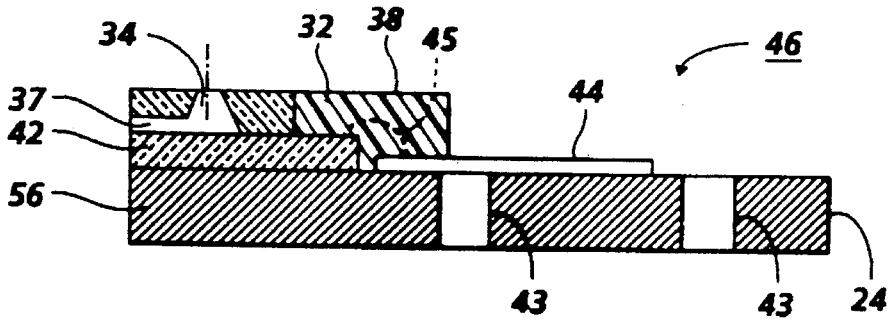
FIG. 5 is a cross-sectional view of the printhead subassembly of printhead, heat sink, printed wire board, and shaped passivation layer for the wire bonds, before installation on the manifold.

The printhead 14 and printed wiring board (PWB) 44 are bonded to the heat sink 24. The printhead terminals and PWB terminals are electrically connected by wire bonds 45 to complete the printhead subassembly 46. This subassembly 46 is placed onto the awaiting molding fixture (not shown) where the passivation layer 38 is deposited, molded, and at least partially cured to assure that surface 32 of the passivation layer remains rigid and substantially coplanar with the printhead surface having the inlet 34. The assembly 46 with the molded passivation layer 38 is shown in FIG. 5. The printhead 14 is bonded to the heat sink 24, so that the printhead inlet 34 is facing in a direction perpendicular to the heat sink. A printed wiring board 44 is also bonded to the heat sink adjacent the printhead. The terminals or contact pads (not shown) of the printhead 14 and printed wiring board 44 are interconnected by wire bonds 45. Locating holes 43 in the heat sink are used when mounting the printhead, PWB, and heat sink assembly 46 to align the printhead inlet and nozzle face relative to the manifold by inserting the stake pins 40 therein. The locating holes 43 in the heat sink 24 are larger than that portion of the stack pins 40 residing therein, so that there is a space 55 therebetween which is filled with an appropriate adhesive (not shown), while the assembly 46 is pressed against the adhesive member 36. One suitable adhesive for the space 55 between the pins 40 and holes 43 in the heat sink is, for example, a UV curable adhesive and is cured by exposure to UV light. This bonding of the pins 40 to the heat sink sets the gap or spacing "t" between the coplanar printhead surface with the inlet and the passivation layer surface 32 and the manifold surface 26, so that the gap t remains fixed when the adhesive member 36 is heated to its flowable state. Once the pins 40 are bonded to the heat sink to fix the gap t, the stake pin ends 41 are then ultrasonically staked to form pin heads 41 and the attachment of the printhead, PWB, and heat sink assembly is complete.

The nozzle face 42 of the printhead 14 is coplanar with the edge 56 of the heat sink 24, edge 39 of the adhesive member, and a portion of the upper edge of the manifold chamber wall 25. This region of the cartridge 10 is covered by a rectangular shaped frame or face plate 48 having a lip 57 around the outer edge thereof and extending in a direction towards the housing. The void area between the frame and the housing is filled with a suitable passivation material (not shown), which may be thermally curable, to form a hermetic seal completely around the printhead by, for example, an injection syringe. The manifold 12 and attached printhead, PWB, and heat sink assembly 46 is cured in an oven, thus simultaneously flowing the preformed adhesive member 36. The heat applied to the adhesive member 36 causes the adhesive to flow along the surfaces in contact therewith until an edge, such as the printhead nozzle face or inlet, is reached whereat the high contact angle of the adhesive member in the flowable state causes it to stop and form a meniscus, thereby preventing the flow of the adhesive member into the printhead inlet 34 or onto the nozzle face 42. As the adhesive member flows at the elevated temperature of about 180° C. to 200,° C., it moves over the substantially planar surfaces which the adhesive member contacts until a corner or other surface discontinuity is reached, such as the printhead inlet, and therefore establishes good contact with the printhead, passivation surface 32, and manifold wall. When the adhesive member is cooled to room temperature, a solid and robust seal impervious to air and ink is created. Because of the good contact and adherence to the adhesive member 36 on the printhead and around the printhead inlet 34, a hermetic seal is made between the cartridge outlet 16 and the printhead inlet 34. Cosmetic bottom cover 28 with ventilation openings 29 is positioned on the housing over the printhead, PWB, and heat sink assembly 46 and ultrasonically welded to the manifold 12.

The ink holding medium 18 is shown as three separate portions, occupying most of the chamber 11. The ink holding medium is saturated with ink and the top manifold cover 27 of the same durable plastic material as the manifold is placed on the manifold and ultrasonically welded thereto. A tube 47 extends from the vent 23 to center of the interior of chamber 11 in the manifold and through openings in each of the ink holding mediums. As is well known in the industry, the printheads will have on-board circuitry for selectively activating the heating elements (not shown) of the thermal ink jet printhead 14 as addressed by electrical signals for the printer controller (not shown) which connects to the cartridge printed circuit board 44 by the cable 21 (FIG. 1) when the cartridge is installed on the carriage 15.

Also within manifold 12 is a member made of a material providing a high capillary pressure, indicated as scavenger 20. Scavenger 20 is a relatively small member which has a capillarity higher than that of medium 18 and serves as a porous capillary barrier between the medium 18 and the output port 16, which leads to the passageway formed by the recess 30 in the chamber wall 25 and the adhesive member 36. Scavenger 20 may be an acoustic melamine foam, one suitable type of which is made by Illbruck USA, Minneapolis, Minn., and sold under the trade name "Wiltec." The scavenger 20 preferably further includes a filter cloth, indicated as 22, which is attached to the melamine using a porous hot-melt laminating adhesive. In general, the preferred material for the filter cloth 22 is monofilament polyester screening fabric.

In FIG. 2, it can be seen that one portion of the outer surface of scavenger 20 abuts the ink holding medium 18, while other portions of the surface are exposed to open space 49 between the medium 18 and the inner walls of chamber 11. The single chamber 11 is so designed that a given quantity of ink may conceivably flow from the medium 18 to and through the scavenger 20, which has a higher capillarity than the medium 18, and through the filter 22, which has a higher capillarity than the scavenger, to the outlet 16 and through the passageway formed by the elongated recess 30 and adhesive member 36 to the printhead inlet 34.

Figure 3:
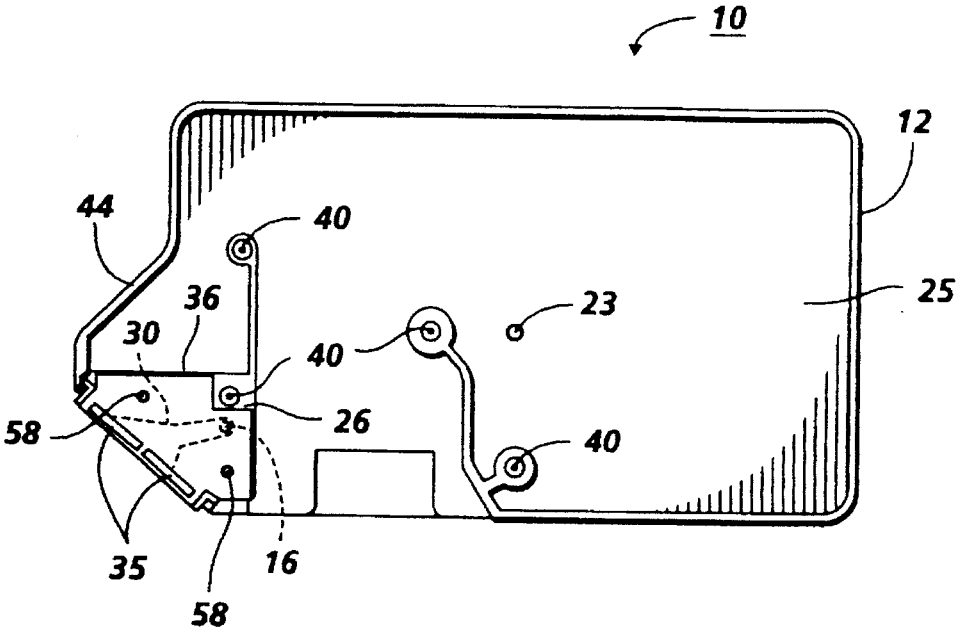
FIG. 3 is a cross-sectional plan view of the cartridge in FIG. 2 as viewed along line 3—3 therein.

FIG. 3 is a bottom view of the manifold 12 as viewed along view-line 3—3, and shows the geometric shape of the preformed adhesive member 36 required to fit the shape of the manifold wall surface 26 in this projection 44 region of the manifold wall 25 and to avoid stake pins 40. The adhesive member is positioned and tacked to the surface 26 of manifold wall 25, as discussed above, and covers the recess 30 and outlet 16 connected thereto, shown in dashed line. The passageway formed by the recess 30 and adhesive member 36 terminates at the through slot 35 therein, which may be similar in size and shape as the printhead inlet 34, but in the preferred embodiment is slightly larger. Thus, the passageway transitions to the relatively thin slot. The hot melt, adhesive member 36 may be any hot melt adhesive with a relatively low tacking temperature of about 95° C. to 105° C. The adhesive member is flowable at about 180° C. and has a high contact angle with the manifold external surface 26. During the adhesive flowing step, the hot melt adhesive member flow towards and surrounds the printhead inlet 34, while the gap t is fixed by the bonding of the pins 40 to the heat sink, so that the adhesive member provides a robust fluidic seal between the manifold wall surface 26 and the printhead surface with the inlet 34 and the coplanar passivation surface 32 as soon as the adhesive member 36 is cooled to ambient temperature. The adhesive member slot, if larger than the printhead inlet, closes as the adhesive member flows to the edge of the inlet and stops by forming a meniscus. Further, the adhesive member, because of the high contact angle of the meniscus formed between the printhead and manifold wall external surface 26, will not flow over the edge of the printhead and over the nozzle face 42.

Figure 4:
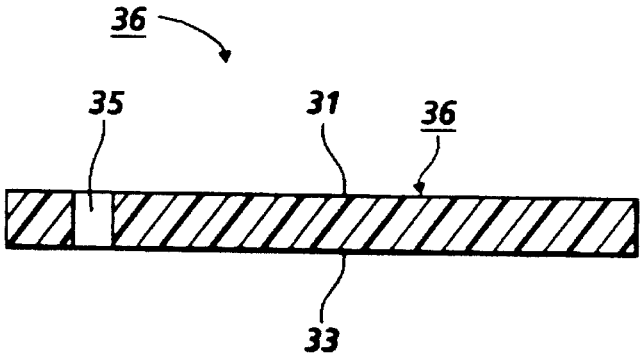
FIG. 4 is a cross-sectional view of the preformed, hot melt seal shown in FIG. 2, showing the seal prior to curing.

In addition to the slots 35 in the adhesive member 36, holes 58 are optionally stamped in the adhesive member for use by an end effector of a robot (not shown) to align the end effector therewith. The robot removes the adhesive member 36 from the carrier strip 50 of FIG. 8 and places it on the wall surface portion 26 of the manifold 12. FIG. 4 is a cross-sectional view of the adhesive member 36 and shows the slots 35, surfaces 31,33. As stated above, the adhesive member may be any suitable hot melt adhesive which is tackified at about 95° C. to 105° C. and has a relatively low flowable temperature of about 180° C. to 200° C. Once the hot melt adhesive is cooled to ambient temperature, it must have good adherence to the surfaces to be sealed. The hot melt adhesive should be insoluble in any of the constituents of the ink. The adhesive member has a thickness of about 4 to 10 mils prior to flowing, and this original thickness sets the fixed gap t through which the adhesive may flow as described above.

As is evident in FIG. 2, the ink must flow against the exposed hot melt adhesive surface 31 of the adhesive member 36. This adhesive should be insoluble in components utilized in the ink; otherwise, the ink would be contaminated by the adhesive and the adhesive eroded so that the ink may leak between the manifold wall surface 26 and the printhead. Once the adhesive member 36 is positioned on surface 26 of manifold wall 25, the adhesive member is heated to about 95° C. for about five to ten seconds at less than 50 psi to tackify the adhesive. The softened or tackified adhesive conforms, slightly flows on the bonding surfaces of the housing wall, and tacks itself to the manifold wall surface 26. The tackified and then cooled adhesive member bonds to the manifold wall with enough strength to prevent relative movement therebetween when the printhead, PWB, and heat sink assembly is positioned on the manifold. Accordingly, the final process for the adhesive member causes the hot melt adhesive to flow to the edges of the planar surfaces and form a meniscus, so that the adhesive does not flow into the printhead inlet 34 or onto the nozzle face 42 of the printhead 14, either during or after assembly of the cartridge 10.

The hot melt adhesive is securely placed without pressure by heating the cartridge in an oven to a temperature of about 180° C. to 200° C. for about 10 to 20 minutes. This temperature is well within the temperature range of common plastic material such as that used for the cartridge manifold 12, so that the flowing of the hot melt adhesive will not affect the manifold. The passivation material 38 for the wire bonds, if not fully cured, and the sealing adhesive around the face plate or frame 48 which surrounds the printhead face 42 and heat sink edges 56 may be concurrently cured with the flowing of the hot melt adhesive member 36, so the passivation material should also have a relatively low curing temperature.

Figure 6:
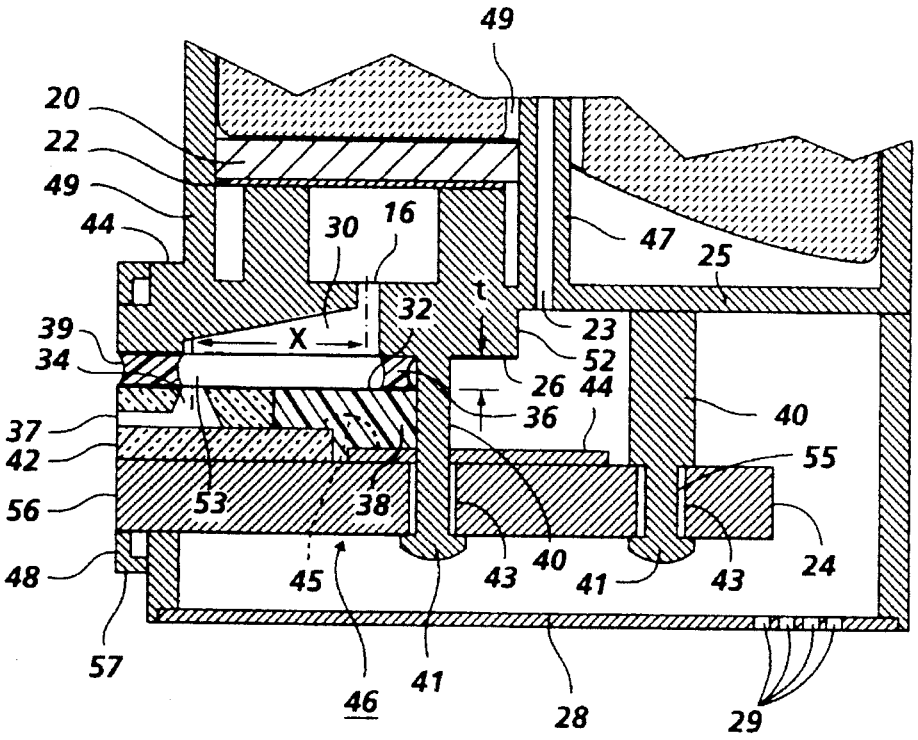
FIG. 6 is a partially shown, cross-sectional view of an alternate embodiment of the preformed, hot melt seal shown in FIG. 1.
Figure 7:
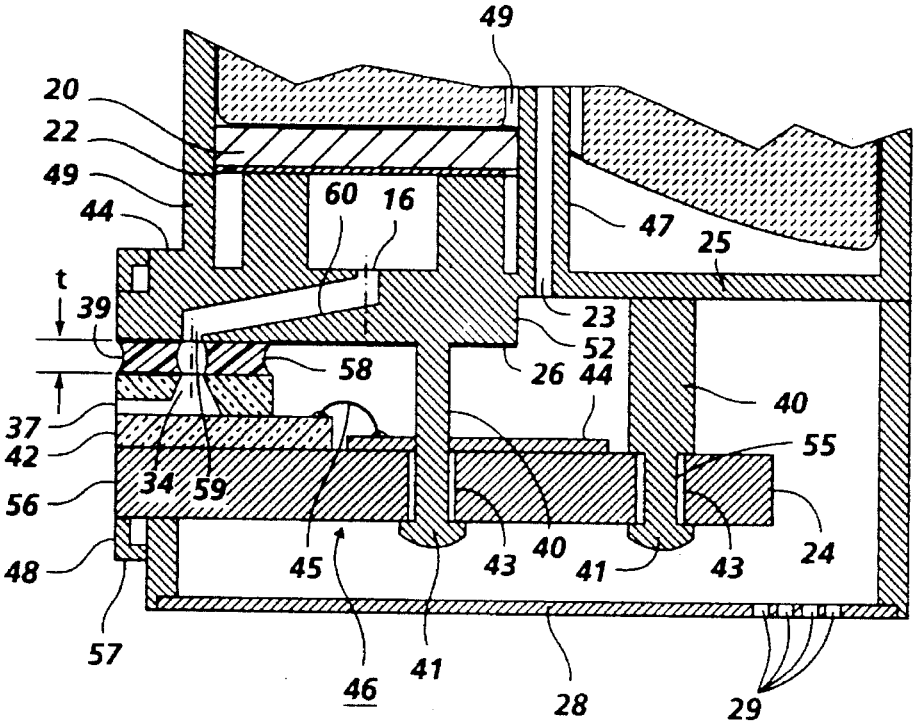
FIG. 7 is a partially shown, cross-sectional view of an alternate embodiment of the passageway between the printhead inlet and manifold outlet, eliminating the need for a shaped wire bond passivation and changing the shape of the preformed hot melt seal.

An alternate embodiment is shown in FIG. 6, wherein the slot 53 in the adhesive member 36 has the same or slightly larger size than the horn shaped recess 30 (as seen in FIG. 3). Thus, surface 32 of the passivation layer 38 forms the bottom surface of the ink passageway between the manifold outlet 16 and printhead inlet 34, while the adhesive member 36 provides the robust fluidic seal. The embodiment of FIG. 6 is otherwise identical to the embodiment in FIG. 2, with only slot 35 therein changed to the larger slot 53. Another embodiment is shown in FIG. 7, which differs from FIG. 2 only in that the ink passageway 60 is internal of the manifold wall, instead of being a recess 30 as shown in FIG. 2. With this configuration, the outlet 16 is connected with the printhead inlet 34, by passageway 60 and passageway outlet 59, so that the hot melt adhesive member 58 is dimensionally smaller than the adhesive member in FIG. 2 and the molded or preformed wire bond passivation layer is not required to provide a support surface 32 for the adhesive member (as necessary for the embodiments of FIGS. 2 and 6). Thus, in FIG. 7, the wire bond passivation and the passivation material to seal around the face plate 48 may be provided and cured after the subassembly of printhead, PWB, and heat sink has been installed on the manifold. The passageway 60 has a relatively large cross-sectional flow area to prevent ink flow resistance during printhead refill even during a high rate of droplet expulsion, so that printhead operation or droplet expulsion frequency is not affected. The passageway 60 is sloped and shaped to provide a smooth ink flow.

Figure 9:
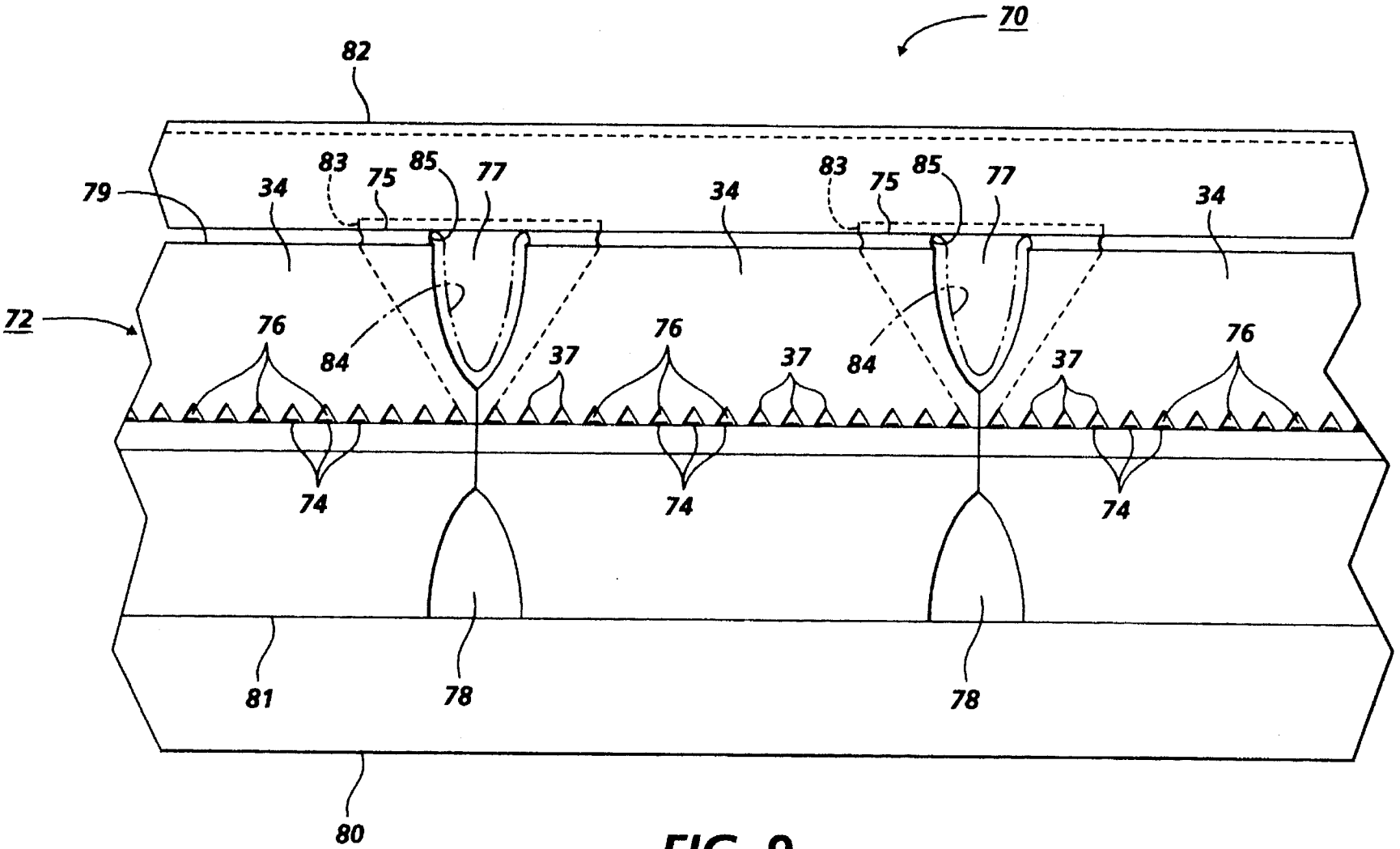
FIG. 9 is an enlarged, partially shown, schematic front view of a full width array printhead formed by the abutment of smaller printhead subunits, showing the manifold and preformed hot melt seal for the printhead subunit ink inlets.

FIG. 9 is an enlarged, partially shown front elevation view of a pagewidth or full width ink jet printhead 70 that is assembled from printhead subunits 72. Schematically illustrated heating elements 74 are shown in each channel 76 through nozzles 37. In this embodiment, small U-shaped grooves 77, 78 may be formed, respectively, between abutted subunits in both the upper surface 79 having ink inlets 34 and in the lower surface 81, so that the surface contact between the abutted subunits 72 is minimized. To strengthen the full width printhead, the U-shaped grooves 78 between the lower surfaces of the subunits may be optionally filled with a flowable epoxy or other suitable adhesive (not shown).

The full width printhead 70 may be further stabilized and strengthened by positioning and bonding the linear array of abutted subunits 72 on a flat structural bar 80 which also acts as a heat sink. Assembly of the full width printhead is complete when an elongated manifold 82 having outlets 83 is mounted on the subunit surface 79 with each manifold outlet 83 aligned with printhead subunit inlets 34. Preformed, flat, hot melt gaskets 75, having a thickness of 4–10 mils and an opening 85 therein, are positioned to surround the printhead inlet prior to installation of the manifold, and then the assembled full width printhead is heated in an oven until the pagewidth printhead 70 reaches about 180° C. to 200° C. for about five minutes to flow the hot melt gasket and seal the printhead subunit inlets to the manifold outlets. Alternatively, the individual gaskets may be replaced with a strip 84 of hot melt adhesive (shown in dashed line) having a full width length with holes 85 therein. The holes 85 may be the same size as the openings in the gaskets 75, which are slightly larger than the subunit inlets 34. When the full width strip is used, it may flow into the U-shaped grooves 77 when the full width printhead 70 is heated because there is no lower surface to keep it from sagging therein by gravity. Thus, the hot melt adhesive seals the manifold outlets 83 to the printhead subunit inlets 34 in the same manner as with the single hot melt adhesive gaskets 75. If the hot melt adhesive moves into the U-shaped grooves 77, the hot melt adhesive only strengthens the full width printhead.

Many modifications and variations are apparent from the foregoing description of the invention and all such modifications and variations are intended to be within the scope of the present invention.

We claim:

1. A printhead assembly for an ink jet printer, comprising:

an ink manifold having a supply of liquid ink and a wall with internal and external surfaces and an outlet therethrough, the internal wall surface being in communication with the ink;

a printhead having nozzles and a surface with an ink inlet, the nozzles and inlet being in communication with each other, and the printhead being fixedly attached to the external surface of the manifold with the inlet confronting the manifold outlet;

a preformed adhesive member having a predetermined thickness and shape and having a slot therethrough, the adhesive member being positioned between the printhead surface with the inlet and the manifold external surface, the slot of the adhesive being aligned with the printhead inlet, the adhesive member being a hot melt adhesive which is not soluble in any constituent of the ink, the adhesive member being tackified at a first temperature above ambient temperature and flowable at a second temperature above said first temperature and having a high contact angle with the manifold external surface and printhead surface the flowable adhesive member contacting both the manifold external surface and the printhead surface, the high contact angle preventing the adhesive member from flowing beyond the the manifold external surface and the printhead surface which said adhesive member contacts, so that the adhesive member surrounds and seals the manifold outlet with the printhead inlet, but does not flow into the printhead inlet; and means for maintaining a spacing between the manifold wall and the printhead surface with the inlet, so that relative movement cannot occur therebetween when the hot melt adhesive flows at said second temperature, thereby controlling the spacing between the the manifold external surface and the printhead surface to be sealed by said adhesive member.

2. The printhead assembly of claim 1, wherein the manifold external surface has a recess connected to the manifold outlet.

3. The printhead assembly of claim 2, wherein the first temperature of the hot melt adhesive, whereat the hot melt adhesive becomes tackified, is at about 95° C. to 105° C. to tack the hot melt adhesive to surfaces in contact therewith; wherein the second temperatures of the hot melt adhesive, whereat the hot melt adhesive flows is about 180° C. to 200° C., and fully rehardens at about ambient temperature; and wherein the adhesive member has a thickness of 4 to 10 mils prior to tacking and flowing.

4. The printhead assembly of claim 3, wherein the printhead assembly further comprises:

a heat sink on which the printhead is fixedly attached;

a printed wire board mounted on the heat sink adjacent the printhead, the printhead and printed wire board being electrically connected by wire bonds; and a passivation layer being formed over the wire bonds in a predetermined shape and having a surface substantially coplanar with the printhead surface.

5. The printhead assembly of claim 4, wherein the adhesive member slot is similar in shape to the printhead inlet and has a geometric shape large enough to cover both the printhead surface and the passivation layer surface.

6. The printhead assembly of claim 4, wherein the adhesive member slot is similar in shape to the recess in the external surface of the manifold wall and has a geometric shape large enough to cover both the printhead surface and the passivation layer surface.

7. The printhead assembly of claim 1, wherein said printhead is a full width printhead array assembled from a plurality of printhead subunits, with each subunit having at least one inlet; wherein said manifold has an outlet for each printhead subunit; and wherein one adhesive member is provided for each printhead inlet.

8. The printhead assembly of claim 7, wherein said adhesive members are integrally formed in a strip of adhesive material having a length substantially equal to the full width printhead array.

* * * * *